US006508174B1

(12) United States Patent
Hahne et al.

(10) Patent No.: US 6,508,174 B1
(45) Date of Patent: Jan. 21, 2003

(54) ELECTROSTATIC PRINTING AID

(75) Inventors: Ernst August Hahne, Allschwill (CH); Franz Knopf, Buhl/Stadt (DE); Thomas Ludwig, Weil am Rhien (DE)

(73) Assignee: Eltex-Elektrostatik GmbH, Deutschland (DE)

( * ) Notice: Subject to any disclaimer, the term of this patent is extended or adjusted under 35 U.S.C. 154(b) by 35 days.

(21) Appl. No.: 09/628,424

(22) Filed: Jul. 28, 2000

(30) Foreign Application Priority Data

Jul. 29, 1999 (DE) ..... 199 35 784

(51) Int. Cl.[7] ..... B41M 35/14

(52) U.S. Cl. ..... 101/489; 101/153; 101/170; 101/DIG. 37; 361/56

(58) Field of Search ..... 101/489, 153, 101/170, 206, 212, 216, 219, DIG. 37; 347/112; 361/52–57

(56) References Cited

U.S. PATENT DOCUMENTS 3,477,369 A * 11/1969 Adamson et al. ..... 101/153
3,641,971 A * 2/1972 Wallberg ..... 118/671
3,875,892 A * 4/1975 Gregg et al. ..... 101/DIG. 37
4,360,850 A * 11/1982 Howard et al. ..... 361/56
4,909,147 A * 3/1990 George et al. ..... 101/170
4,966,555 A * 10/1990 Zagorski ..... 101/153 X

* cited by examiner

*Primary Examiner*—Andrew H. Hirshfeld
*Assistant Examiner*—Ninh Chau
(74) *Attorney, Agent, or Firm*—Antonelli, Terry, Stout & Kraus, LLp

(57) ABSTRACT

The invention relates to an electrostatic printing aid to assist with the transfer of printing ink that contains flammable solvents during printing with a high-voltage generator for generating an electrostatic high voltage and with a voltage device to transfer the high voltage onto a web to be printed that is in contact with a printing cylinder or plate, characterized in that the high-voltage generator is equipped with an output limiter and in that the voltage transfer device comprises slip rings, slip ring brushes, contact rollers or springs, and/or electrically conductive roller or ball bearings.

9 Claims, 1 Drawing Sheet

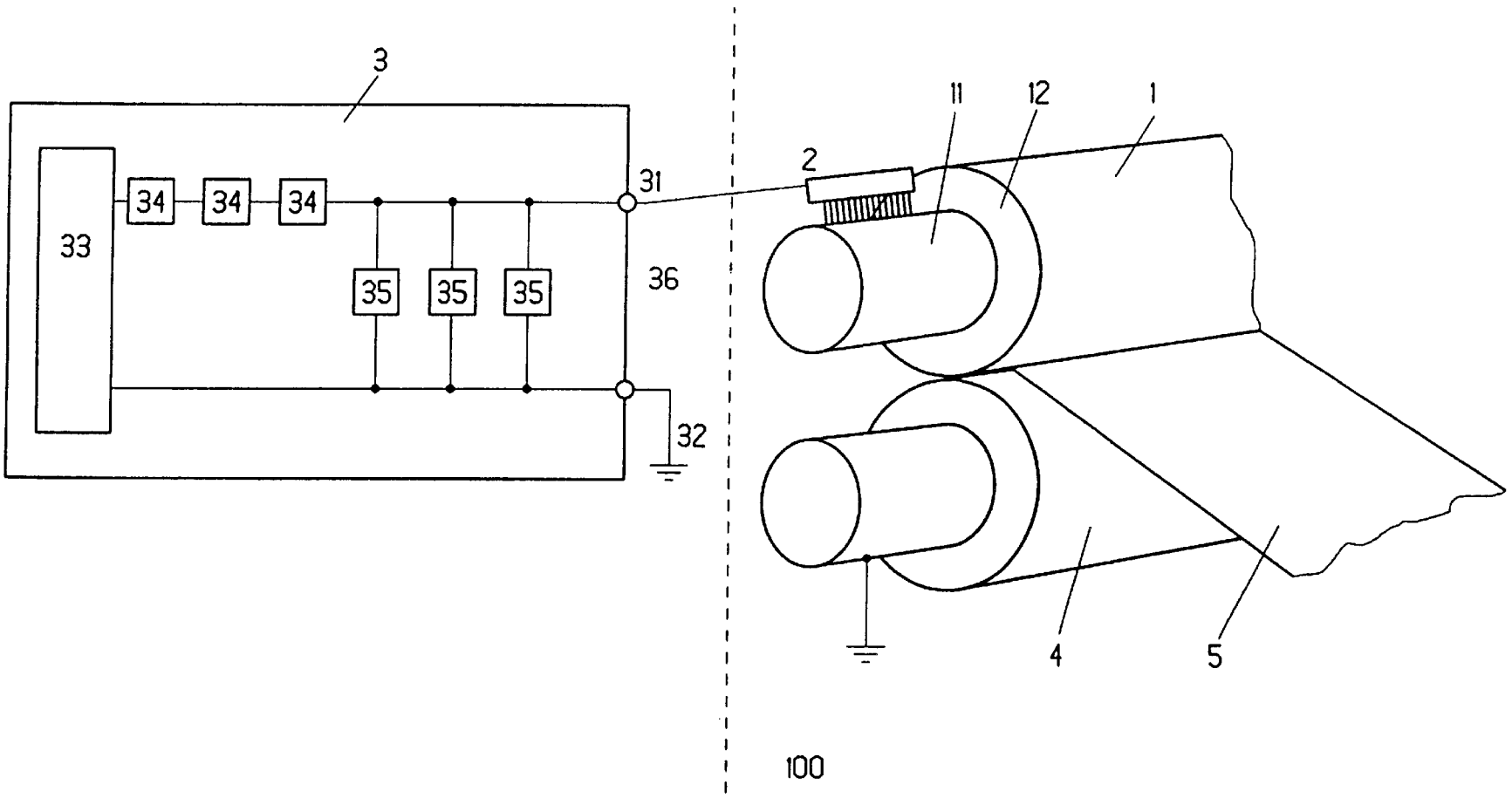
1
12
11
2
5
4
100
31
36
32
3
35
35
35
34
34
34
33

ELECTROSTATIC PRINTING AID

BACKGROUND OF THE INVENTION

The invention relates to an electrostatic printing aid.

Electrostatic printing aids to assist with the transfer of printing ink are known in a multitude of designs. To avoid fires and explosions where such printing aids are used with printing inks containing flammable solvents, measures must be taken to prevent ignition of the mixture generated from the mixing of the solvents with air. In environments that are subject to explosion hazards, the electrostatic printing aid is subject to special safety precautions.

The voltage transfer with known electrostatic printing aids is carried out with normal voltage transfer devices, such as corona electrodes and rotational transformers. The safety standards for operating such voltage transfer devices in environments that are subject to explosion hazards require more expensive and complicated designs of these voltage transfer devices.

Another known design provides for encapsulation of the voltage transfer device by way of a compressed air lock (U.S. Pat. No. 4,966,555), which also results in a complicated design and expensive operation.

A known generic, so-called intrinsically safe electrostatic printing aid (U.S. Pat. No. 4,360,850), achieves the required safety by monitoring the resistive as conductivity of a connected impedance to the high-voltage generator. When the conductivity exceeds the setpoint limit, the output voltage of the high-voltage generator is switched off. This means that the resistance value of a consumer that is connected to the generator must not fall below a preset minimum resistance value in environments that are subject to explosion hazards.

The consumer of the electrostatic printing aids relates to a cylinder onto which an electrically conductive coating has been applied, the so-called impression cylinder. The conductivity of the coating is thus decisive for the safe functioning of the known generator. However, it has been shown that the electrical conductivity of such cylinder coatings can only be adjusted within wide tolerances during manufacture. In addition, this conductivity is highly dependent on temperature and aging factors.

Thus, practice has shown that for trouble-free operation of the known system, cylinder coatings with a conductivity several multiples lower than what is needed by the conductivity limit of the safety regulations are required. In this low conductivity range, it frequently is no longer possible to achieve satisfactory performance with the known system.

SUMMARY OF THE INVENTION

Thus, the objective of this invention is to develop an electrostatic printing aid to assist with the transfer of printing ink containing flammable solvents during printing which can be used in environments that are subject to explosion hazards and that has a simpler design and higher operating efficiency, without endangering safety, and one where safety and functionality do not depend on the widely spread ranges of electrical conductivity of the user that is connected to the printing aid.

According to the invention, this problem is solved by providing the high voltage generator with an adjustable limitation device for its power output and designing the voltage transfer device as slip rings, slip ring brushes, contact rollers, contact springs and/or electrically conductive roller or ball bearings.

Thus, according to the teaching of the invention, a high-voltage generator with a maximum output performance is provided to keep the design of the voltage transfer device as simple as possible; for example as a slip ring brush, as a contact roller or spring, or as an electrically conductive ball bearing. Thus, in contrast with prior art practice, complicated and high-cost encapsulated voltage transfer devices are not necessary. Instead, all prior-art direct voltage transfer devices can be used as they have been up to now for applications that are not subject to explosion hazards. Moreover, no restrictions with respect to the functionality relating to the electrical conductivity of a connected consumer need be considered Thus, the coatings for the impression cylinder can be used over a significantly wider conductivity range, which comes much closer to the technical feasibility during the manufacture of such coatings, and which expands the implementation of an electrostatic printing aid.

A suitable design of the high-voltage generator that has a maximum electrical output efficiency, which can be adjustable or non-adjustable, comprises a voltage limitation for the maximum voltage and/or a current limitation for maximum current. An especially suitable design has redundant voltage and current limitation, which assures safety even if one or two faults that are independent of each other occur in the voltage limitation device and/or current limitation device.

Thus, the high voltage generator may have a constant voltage and the limitation device then includes current limiters; alternatively, the high voltage generator may be a constant current source and the limitation device may then include voltage limiters. When the high voltage generator has an adjustable voltage, the limitation device may include voltage limiters and current limiters.

BRIEF DESCRIPTION OF THE DRAWINGS

An embodiment of the invention is subsequently detailed, making reference to the drawing, which shows as schematic electrical circuit of the invention.

DETAILED DESCRIPTION OF THE PREFERRED EMBODIMENT

A high-voltage generator 3 generates an electrostatic high voltage, which has been connected through its output terminals 31 and 32 to a voltage transfer device which has been developed as an electrical brush, collectively referred to as voltage transfer device 2, which engages a shaft 11 of the impression cylinder referred to as 1. The impression cylinder has a casing that is coated with an electrically conductive coating 12, which transfers the electrical charge to the web 5 that is to be printed and which is located between the impression cylinder and a grounded printing cylinder 4. The area that is subject to explosion hazards, due to the solvent/air mixture, is referred to as 100.

The high-voltage generator 3 comprises a voltage device 33 for generating an adjustable high voltage, at the one terminal where three current limitation devices 34 are connected in series. After this series connection of the current limitation devices 34, a parallel connection of the three voltage limitation devices 35 for the high voltage at the electrical output terminals 31 and 32 of the high-voltage device 3 has been provided, collectively referred to as 36. Through this individual triple redundant protective circuit configuration, the output power of the high voltage 36 is limited to a maximum value. For example, the maximum electrical energy of the output power can be set to not exceed 350 mJ. Preferably, the voltage limiters 35 limit the voltage to up to 3000V. Preferably the current limiters 34 limit the current to up to 12 mA.

It is thus assured, that the electrical charge which has been introduced into the area that is subject to explosion hazards will prevent ignition of the solvent-containing air, independent of the resistive conductivity of the impression cylinder coating.

What is claimed is:

1. An electrostatic printing aid to assist with the transfer of printing ink containing flammable solvents during printing, comprising:

a high voltage generator for generating electrostatic high voltage at output terminals, including a limitation device for limiting output power to a level greater than zero, but less than the ignition power value of the solvents; and thus limiting energy in any spark and preventing ignition of said solvents; and a high voltage transfer device electrically connected to said output terminals for transferring said high voltage to an impression cylinder in contact with a web to be printed, said voltage transfer device including at least one of slip rings, slip ring brushes, contact rollers, contact springs and electrically conductive bearings.

2. The electrostatic printing aid according to claim 1, wherein said high voltage generator has an adjustable voltage and said limitation device includes voltage limiters and current limiters.

3. The electrostatic printing aid according to claim 1, wherein said high voltage generator has a constant voltage and said limitation device includes current limiters.

4. The electrostatic printing aid according to claim 1, wherein said high voltage generator is a constant current source and said limitation device includes voltage limiters.

5. The electrostatic printing aid according to claim 1, wherein a maximum electrical energy at said output terminals does not exceed 350 mJ.

6. The electrostatic printing aid according to claim 1, wherein said limitation device includes a plurality of voltage limiters connected in parallel to said output terminals.

7. The electrostatic printing aid according to claim 6, wherein said high voltage is limited to 3000 V.

8. The electrostatic printing aid according to claim 1, wherein said limitation device includes a plurality of current limiting devices connected in series to said output terminals.

9. The electrostatic printing aid according to claim 8, wherein said current limiting devices limit current to 12 mA.

* * * * *